US008369719B2

(12) United States Patent
Seol et al.

(10) Patent No.: US 8,369,719 B2
(45) Date of Patent: Feb. 5, 2013

(54) IMAGE FORMING APPARATUS, FUSING DEVICE THEREOF AND METHOD OF CONTROLLING FUSING DEVICE

(75) Inventors: Dong Jin Seol, Suwon-si (KR); Tae Gyu Kim, Hwasung-gun (KR); Chang Hoon Jung, Seoul (KR); Jae Hyeok Jang, Suwon-si (KR); Seung Jun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 900 days.

(21) Appl. No.: 12/346,277

(22) Filed: Dec. 30, 2008

(65) Prior Publication Data

US 2009/0175645 A1 Jul. 9, 2009

(30) Foreign Application Priority Data

Jan. 4, 2008 (KR) ..... 10-2008-0001343
Sep. 1, 2008 (KR) ..... 10-2008-0085800

(51) Int. Cl.
*G03G 15/20* (2006.01)

(52) U.S. Cl. ..... 399/33; 399/328; 399/329; 399/335; 399/69

(58) Field of Classification Search ..... 399/33, 399/335
See application file for complete search history.

(56) References Cited

U.S. PATENT DOCUMENTS 7,129,448 B2 * 10/2006 Matsunaga et al. ..... 219/619
7,167,657 B2 * 1/2007 Inoue et al. ..... 399/44
7,299,003 B2 * 11/2007 Kurotaka et al. ..... 399/329
7,792,445 B2 * 9/2010 Sone et al. ..... 399/67
2003/0228179 A1 * 12/2003 Yaomin et al. ..... 399/329
2004/0022552 A1 * 2/2004 Yura et al. ..... 399/69
2004/0062578 A1 * 4/2004 Kim et al. ..... 399/328
2006/0051111 A1 * 3/2006 Kishi et al. ..... 399/33
2006/0165449 A1 * 7/2006 Ito et al. ..... 399/329
2006/0177251 A1 8/2006 Uehara et al.
2006/0216079 A1 * 9/2006 Nanjo ..... 399/333
2006/0251440 A1 * 11/2006 Tatematsu et al. ..... 399/69
2007/0059010 A1 * 3/2007 Arimoto et al. ..... 399/69
2007/0071475 A1 * 3/2007 Blair et al. ..... 399/68
2007/0183798 A1 * 8/2007 Moriguchi et al. ..... 399/33
2007/0292175 A1 * 12/2007 Shinshi ..... 399/329

(Continued)

FOREIGN PATENT DOCUMENTS

KR 10-2006-0090740 8/2006

OTHER PUBLICATIONS

English language abstract of KR 10-2006-0090740, published Aug. 16, 2006.

*Primary Examiner* — Walter L Lindsay, Jr.
*Assistant Examiner* — David Bolduc
(74) *Attorney, Agent, or Firm* — Stanzione & Kim, LLP

(57) ABSTRACT

An image forming apparatus that is capable of preventing a damage to a fusing belt or hazardous conditions due to the overheating of the fusing belt and a fusing device thereof are disclosed. The image forming apparatus has a fusing device including a fusing belt, a heat source disposed in the fusing belt, a support member to support the fusing belt, the support member having an opening through which heat emitted from the heat source passes to at least a portion of the fusing belt, and a first temperature sensor positioned to measure temperature of the fusing belt at the portion directly heated by radiant heat transmitted through the opening. A control unit of the image forming apparatus controls the heat source based on the temperature measured by the first temperature sensor.

18 Claims, 11 Drawing Sheets

U.S. PATENT DOCUMENTS

2008/0044196 A1* 2/2008 Seo et al. ..... 399/69
2008/0131161 A1* 6/2008 Kikuchi ..... 399/70
2008/0232871 A1* 9/2008 Jung et al. ..... 399/329
2008/0240748 A1* 10/2008 Kinouchi et al. ..... 399/33
2008/0298824 A1* 12/2008 Kanno ..... 399/33
2008/0298862 A1* 12/2008 Shinshi ..... 399/324
2009/0092423 A1* 4/2009 Shin et al. ..... 399/329
2009/0110451 A1* 4/2009 Jung et al. ..... 399/329
2009/0232534 A1* 9/2009 Haseba et al. ..... 399/69
2009/0324272 A1* 12/2009 Barton et al. ..... 399/69

* cited by examiner

IMAGE FORMING APPARATUS, FUSING DEVICE THEREOF AND METHOD OF CONTROLLING FUSING DEVICE

CROSS-REFERENCE TO RELATED APPLICATION

This application claims the benefit of Korean Patent Application Nos. 2008-1343 and 2008-85800, filed on Jan. 4, 2008 and Sep. 1, 2008 in the Korean Intellectual Property Office, the disclosure of which is incorporated herein by reference.

BACKGROUND OF THE INVENTION

1. Field of the Invention

The present invention relates to an image forming apparatus, and, more particularly, to an image forming apparatus including a fusing device to fix a toner image to print media.

2. Description of the Related Art

An image forming apparatus is an apparatus that forms an image on print media, and may include, for example, a printer, a copier, a facsimile, a multifunctional machine integrating various functions, and the like.

An electro-photographic type image forming apparatus generally scans light on a photoconductor charged with a predetermined electric potential to form an electrostatic latent image on the surface of the photoconductor, and supplies toner to the latent image to develop into a visible toner image. The toner image, developed on the photoconductor, is transferred to print media, which is then fixed to the print media by passing the print media through a fusing device.

A widely used fusing device includes a heat roller having a heat source mounted therein and a press roller in pressing contact with the heat roller to form a fusing nip. When the print media, to which the toner image has been transferred, enters between the heat roller and the press roller, the toner image is fixed to the print media by the heat and pressure at the fusing nip.

The heat roller however due to its large heat capacity requires a significant warm up time to reach the temperature sufficient to carry out the fixing operation when, for example, the image forming apparatus is restarted from being idle for some time or is initially operated after being powered up.

In recent years, there has been suggested a fusing device that is capable of rapidly increasing the temperature of the nip to a sufficient temperature for fusing the toner in response to the demand for high-speed image forming apparatuses. An example of such fusing device is disclosed in United States Patent Application Publication No. US 2006/0177251 by Uehara et al. ("Uehara").

The fusing device of Uehara includes a press roller, a fusing belt that rotates with the rotation of the press roller, a halogen heater mounted in the fusing belt to heat the fusing belt, and a belt guide member to support the inner circumference of the fusing belt and to form a fusing nip together with the press roller.

Some of heat produced by the halogen heater heats the belt guide member adjacent to the fusing nip, and the fusing belt is indirectly heated by heat transmitted from the heated belt guide member. Also, some of heat from the halogen heater directly heats the fusing belt at the side opposite to the fusing nip. Consequently, the fusing belt is heated to a predetermined temperature in a relatively short time by the halogen heater.

While these type of fusing devices described by Uehara may allow rapid heating of the fusing belt, and thus may reduce warm-up time when the device operates as intended, when the fusing device does not operate normally, however, the fusing belt may become damaged or accidents threatening safety may occur due to the overheating of the fusing belt.

For example, when the fusing belt does not rotate as it should, due to, e.g., a slippage between the press roller and the fusing belt or due to malfunctions in the drive system delivering rotational power to the press roller, etc., the temperature of the fusing belt at the parts where the fusing belt is directly heated by the halogen heater may rapidly increase, and may overheat, which may result in the fusing belt being damaged, and/or an occurrence of hazardous accident, such as a fire.

BRIEF DESCRIPTION OF THE DRAWINGS

Various aspects and advantages of the embodiments of the present invention will become apparent and more readily appreciated from the following description of the embodiments, taken in conjunction with the accompanying drawings, of which.

DETAILED DESCRIPTION OF SEVERAL EMBODIMENTS

Figure 1:
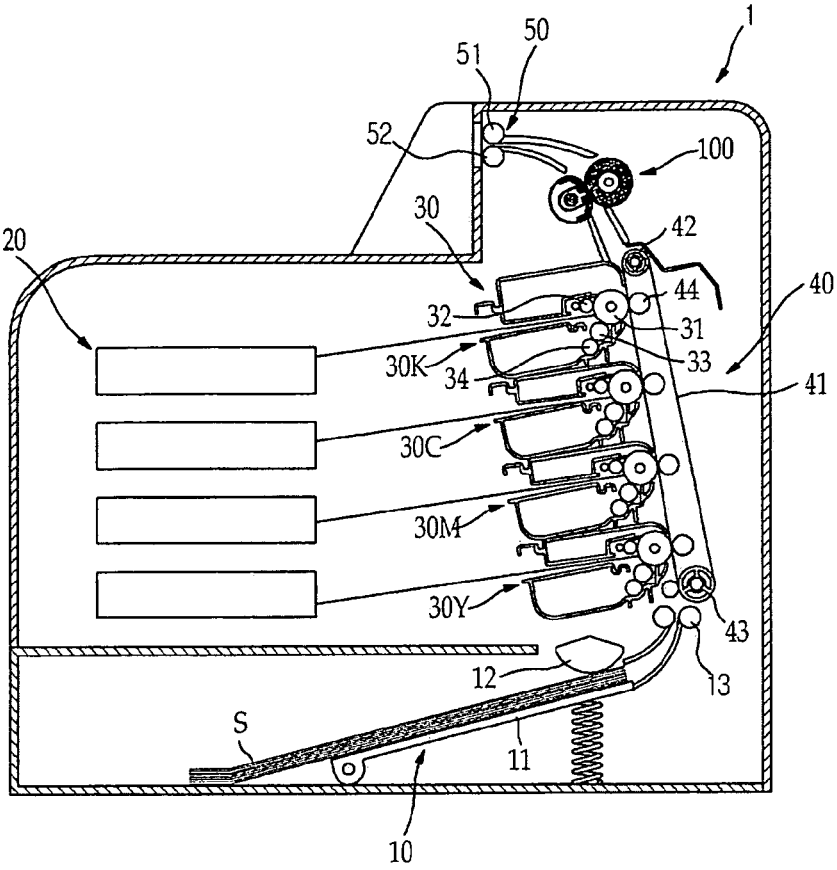
FIG. 1 is a view illustrating the relevant structure of an image forming apparatus according to an embodiment of the present invention.

Reference will now be made in detail to the embodiment of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

FIG. 1 is a view illustrating the relevant structure of an image forming apparatus 1 according to an embodiment of the present invention.

As shown in FIG. 1, the image forming apparatus 1 may include a print media supply device 10, a light scanning device 20, a developing device 30, a transfer device 40, a fusing device 100, and a print media discharge device 50.

The print media supply device 10 supplies print media S to the developing device 30. The print media supply device 10 includes a tray 11 on which the print media S is loaded and a pickup roller 12 to pick up, one medium at a time, the print media S loaded on the tray 11. The print media, picked up by the pickup roller 12, is fed to the developing device 30 by feed rollers 13.

The developing device 30 develops a toner image according to image information, which may be input from an external instrument, such as, e.g., an external host computer. In this embodiment, the image forming apparatus 1 is shown a color image forming apparatus, and includes the four developing units 30Y, 30M, 30C, and 30K containing different color toners, for example yellow (Y), magenta (M), cyan (C), and black (K) toners, respectively.

The developing units 30Y, 30M, 30C, and 30K each may have a photoconductor 31 on the surface of which an electrostatic latent image is formed by the light scanning device 20. The light scanning device 20 irradiates lights corresponding to the yellow (Y), magenta (M), cyan (C), and black (K) image information to the photoconductors 31 of the respective developing units.

The developing units 30Y, 30M, 30C, and 30K each may further have a charge roller 32 to charge the corresponding photoconductor 31, a developing roller 33 to supply toner to the electrostatic latent image of the corresponding photoconductor 31 to develop a toner image, and a supply roller 34 to supply toner to the corresponding developing roller 33.

The transfer device 40 transfers the toner images, developed on the photoconductors 31, to a print medium. In the embodiment shown, the transfer device 40 may include a transfer belt 41 running in contact with the photoconductors 31, a transfer belt drive roller 42 to drive the transfer belt 41, a tension roller 43 to maintain the tension of the transfer belt 41, and four transfer rollers 44 to transfer the toner images, developed on the photoconductors 31, to the print medium.

The print media may be carried on the transfer belt 41, and thus may travel at the same speed as the running speed of the transfer belt 41. At this time, voltages having polarities opposite to the toners attached to the respective photoconductors 31 are applied to the respective transfer rollers 44, with the result that the toner images on the respective photoconductors 31 are transferred to the print media.

The fusing device 100 fixes to the print media the toner images that had been transferred onto the print media by the transfer device 40. The details of the fusing device 100 are described below.

The print media discharge device 50 discharges the print media out of the image forming apparatus 1. The print media discharge device 50 may include a discharge roller 51 and a discharge backup roller 52 disposed opposite to the discharge roller 51.

Figure 2:
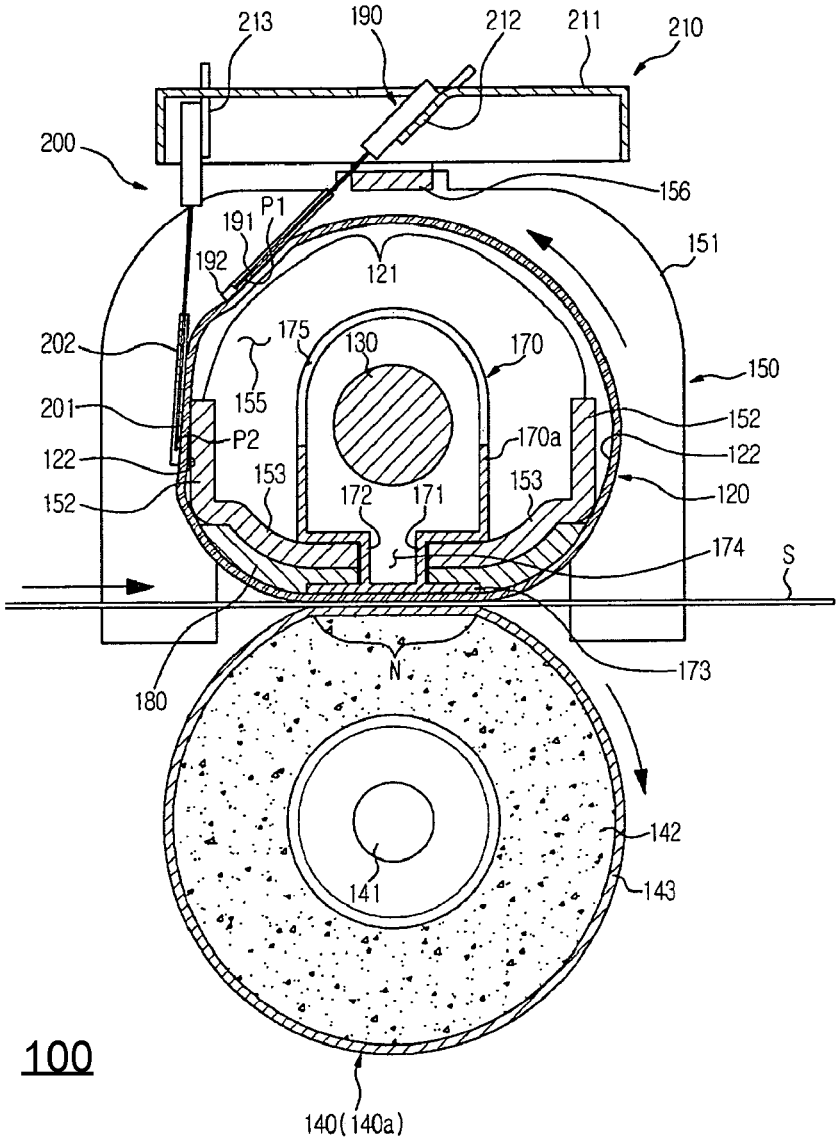
FIGS. 2 to 4 are a sectional view, an assembled perspective view, and an exploded perspective view, respectively, illustrating the structure of a fusing device according to an embodiment of the present invention.
Figure 3:
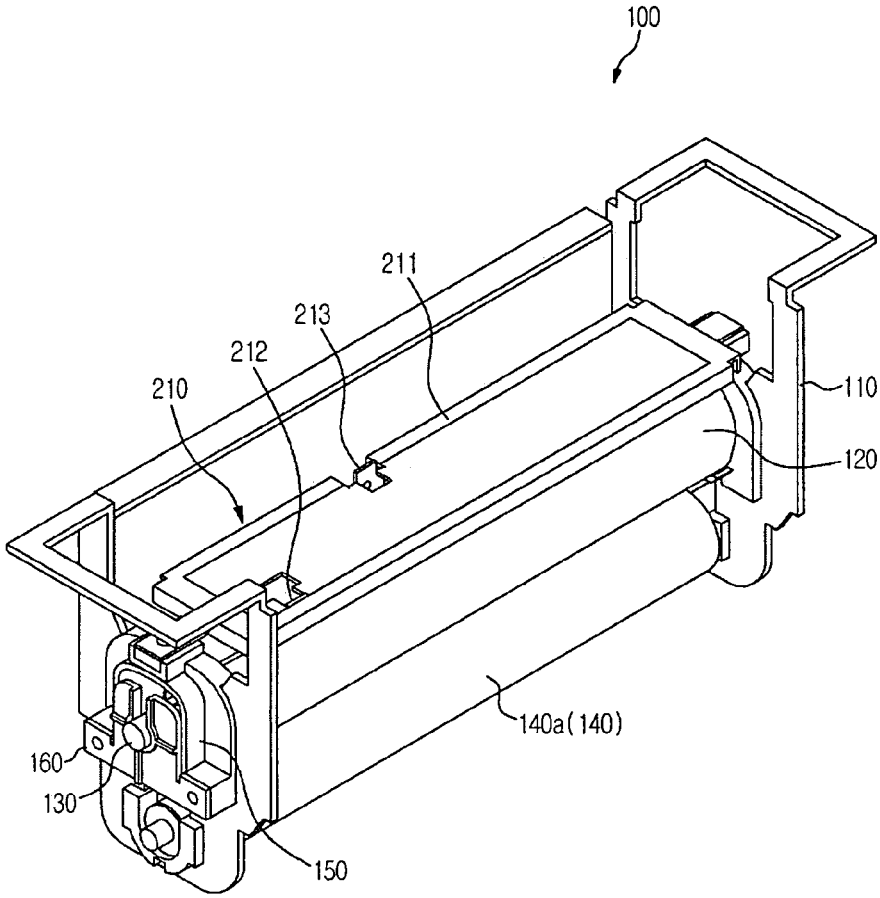
Figure 4:
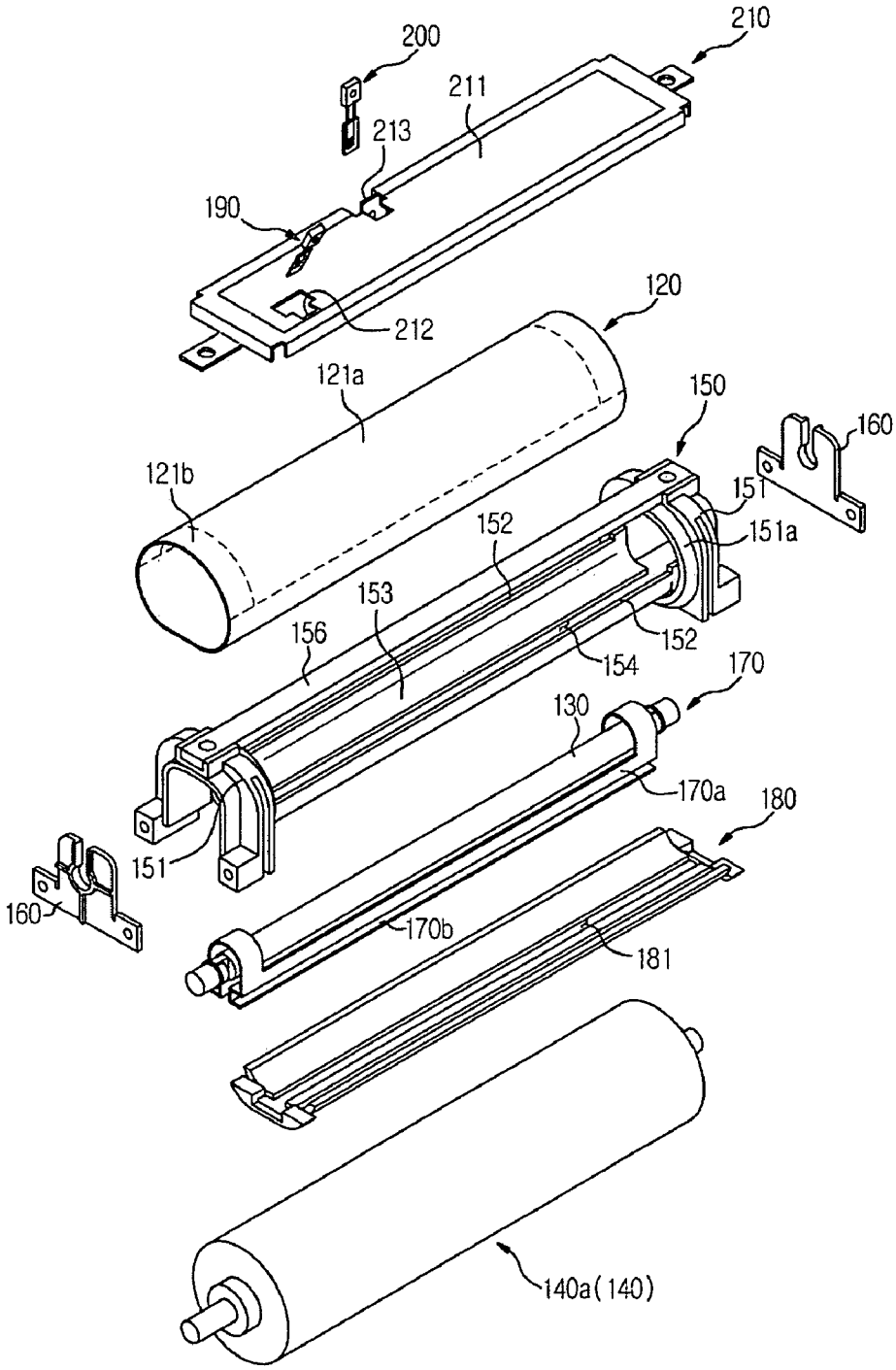

FIGS. 2 to 4 are a sectional view, an assembled perspective view, and an exploded perspective view respectively illustrating the relevant structure of a fusing device 100 according to an embodiment of the present invention. For brevity, some components of the fusing device are not shown in FIGS. 2 to 4, and are not described herein so as to avoid obscuring the following description with unnecessary details. For convenience sake only, In FIG. 2, the first temperature sensor 190 and the second temperature sensor 200 are illustrated on a single cross-sectional view, the temperature sensors may not necessarily be placed on the same plane.

As shown in FIGS. 2 to 4, the fusing device 100 according to the embodiment may include a main frame 110, a fusing belt 120, a heat source 130, a press member 140, and a support member 150. The print media S, to which the toner images have been transferred, passes between the press member 140 and the fusing belt 120. At this time, the toner images are fixed to the print media by application of heat and pressure.

The main frame 110 supports components constituting the fusing device. The main frame 110 may be fixed to an apparatus frame (not shown) provided in the image forming apparatus.

The press member 140 is disposed to oppose the fusing belt 120. The press member 140 may be made to press against the fusing belt 120 by, e.g., a press unit (not shown), to form a fusing nip N. The press member 140 may include a press roller 140*a* that rotates when rotational power is received from a drive source (not shown).

According to an embodiment, the press roller 140*a* may have a shaft 141, which may be made of metallic material, such as, e.g., aluminum, steel or the like, and an elastic layer 142 that is elastically deformable, as the press roller 140*a* is pressed against the fusing belt 120, so as to form the fusing nip N between the press roller 140*a* and the fusing belt 120. The elastic layer 142 may be generally made of, e.g., silicone rubber. On the surface of the elastic layer 142 may be formed a release layer 143 to prevent the print media from adhering to the surface of the press roller 140*a*.

The fusing belt 120 may be rotatably supported by the support member 150. The fusing belt 120 may be made to rotate by the pressing engagement with the press roller 140*a*. The fusing belt 120 forms the fusing nip N together with the press roller 140*a*. The fusing belt 120 may be made of a heat-resistant material, and may have a width corresponding to the length of the press roller 140*a*. The fusing belt 120 is heated by the heat source 130 to transmit heat to the print media S passing through the fusing nip N.

According to an embodiment, the heat source 130 may be disposed in the fusing belt 120. Opposite ends of the heat source 130 may be coupled to side covers 160. The side covers 160 may be fixed to the support member 150, with the result that the heat source 130 is supported by the support member 150. As an example, the heat source may be a halogen lamp.

According to an embodiment, the support member 150 may be configured to surround the heat source 130. The support member 150 may be made of material with a high-stiffness or rigidity that is not easily deformed by an external force.

The support member 150 may include two side parts 151, two support plates 152, and two bent plates 153.

The side parts 151 are disposed at opposite sides of the support member 150. The belt support parts 151*a* are disposed to protrude from the inner portion of the respective side parts 151 to support opposite ends of the fusing belt 120. The side parts 151 may be formed integrally with the support member 150 or formed separately from the support member 150.

The support plates 152 extend in the lateral direction between the side parts 151 to interconnect the side parts 151. The support plates 152 may be arranged to extend spaced apart from each other at the front and back portion of the support member 150, respectively as shown in FIG. 2.

The bent plates 153 are bent inward from the respective support plates 152. Between the bent plates 153 is defined a first opening 154. Some of heat emitted from the heat source 130 passes through the first opening 154, and is transmitted toward the fusing nip N.

The support member 150 has a second opening 155 formed at the side opposite to the first opening 154. The second opening 155 allows radiant heat from the heat source 130 to pass through the support member 150, and be directly transmitted to the fusing belt 120. Hereinafter, a portion directly radiant-heated through the second opening 155 of the support member 150 at the fusing belt 120 will be referred to as a first heated portion, which is indicated by reference numeral 121 (see FIG. 2).

In this embodiment, the support plates 152 of the support member 150 are disposed between the heat source 130 and the fusing belt 120. Consequently, radiant heat from the heat source 130 is prevented from being directly transmitted to the fusing belt 120. Hereinafter, a portion indirectly heated by the heat source 130 as a result of radiant heat from the heat source 130 not being directly transmitted to the fusing belt 120 will be referred to as a second heated portion, which is indicated by reference numeral 122.

The support member 150 may further include a reinforcing plate 156 to interconnect the side parts 151 outside the fusing belt 120. The reinforcing plate 156 increases the strength of the support member 150 to prevent the deformation of the support member 150.

As shown in FIGS. 2 and 4, the fusing device 100 may further include a nip forming member 170 and a belt guide member 180.

The nip forming member 170 supports the inside of the fusing belt 120 to form the fusing nip N between the press roller 140*a* and the fusing belt 120.

The nip forming member 170 may include a body part 170*a* and a nip forming part 170*b*. The nip forming part 170*b* includes a first extension 171 extending from one end of the body part 170*a* toward the fusing belt 120, a second extension 172 extending from the other end of the body part 170*a* toward the fusing belt 120, and a press part 173 provided at the ends of the first extension 171 and the second extension 172. One side of the press part 173 presses the inside of the fusing belt 120 to form the fusing nip N.

Between the first extension 171 and the second extension 172 is defined a nip heating part 174. The heat source 130 directly radiant-heats the press part 173 through the nip heating part 174 of the nip forming member 170, and the heated press part 173 transmits heat to the fusing belt 120.

The nip forming member 170 is preferably made of a metal material having low specific heat and high heat conductivity such that the temperature of the nip forming member 170 can rapidly increase to effectively transmit the heat to the fusing belt 120, and to the print media S. For example, the nip forming member 170 may be made of aluminum, steel, copper, or phosphor bronze.

The body part 170*a* of the nip forming member 170 has an opening 175 formed at the side opposite to the nip heating part 174. The heat source 130 may directly radiant-heat the first heated portion 121 of the fusing belt 120 through the opening 175 of the nip forming member 170 and the second opening 155 of the support member 150. Consequently, the temperature of the fusing belt 120 may more rapidly increase, and the lowering in temperature of the fusing belt 120 may be reduced during the rotation of the fusing belt 120.

The belt guide member 180 supports the inside of the fusing belt 120, in the vicinity of the fusing nip N, and guides the fusing belt 120. The belt guide member 180 may be made of heat-resistant plastic, such as polyether ether ketone (PEEK) or polyphenylene sulfide (PPS). The top portion of the belt guide member 180 is supported by the support member 150, and the belt guide member 180 is provided at the middle thereof with an opening 181 corresponding to the nip heating part 174 of the nip forming member 170.

The bottom of the belt guide member 180 pressingly supports the top side of the press part 173 of the nip forming member 170 (i.e., the side of pressing part 173 opposite to the side supporting the fusing belt 120) to oppose the pressing force imparted by the press roller 140*a*. Also, the opening 181 of the belt guide member 180 supports the first extension 171 and the second extension 172 of the nip forming member 170 to prevent a widening of the nip heating part 174 of the nip forming member 170.

Also, as shown in FIGS. 2 and 4, the fusing device 100 may further include a first temperature sensor 190 to measure the temperature of the fusing belt 120 at the portion of the fusing belt 120, which is directly radiant-heated by the heat source, i.e., at the first heated portion 121 of the fusing belt 120. The image forming apparatus I takes an appropriate step based on the temperature measured by the first temperature sensor 190 to prevent the overheating of the fusing belt 120.

The first heated portion 121 of the fusing belt 120 includes a print media contact part 121*a*, which comes into contact with the print media S during the rotation of the fusing belt 120, and an edge part 121*b* located outside the print media contact part 121*a* such that the edge part 121*b* does not come into contact with the print media S.

The first temperature sensor 190 is mounted at the edge part 121*b*, such that the first temperature sensor 190 is in contact with the outside of the fusing belt 120, to measure the temperature of the fusing belt 120. The edge part 121*b* of the first heated portion 121 does not transmit heat to the print media S, and therefore, the temperature of the edge part 121*b* may remain higher than that of the print media contact part 121*a*. Although not required in practicing the embodiment, it may thus be preferred to monitor the temperature of the fusing belt 120 at the edge part 121*b* having a relatively higher temperature in preventing the overheating of the fusing belt 120. Also, as the first temperature sensor 190 is mounted in contact with the fusing belt 120, the surface of the fusing belt 120 may become scratched. While also not required, it may thus be also preferred to locate the first temperature sensor 190 at the edge part 121*b* since the possible affect on the print quality of the potential damages to the fusing belt 120 may be reduced.

The fusing device 100 may further include a second temperature sensor 200. The image forming apparatus 1 may maintain the fusing belt 120 at an appropriate fusing temperature based on the temperature measured by the second temperature sensor 200. Also, the image forming apparatus 1 reliably determines whether the fusing belt 120 is overheating using the temperature measured by the second temperature sensor 200 as well as the temperature measured by the first temperature sensor 190.

The second temperature sensor 200 may be disposed to measure the temperature of the fusing belt 120 at the second heated portion 122 of the fusing belt 120 indirectly heated under the influence of a structure (for example, the support plates 152 of the support member) disposed between the heat source 130 and the fusing belt 120.

When the first temperature sensor 190 is disposed to measure the temperature of the fusing belt 120 at a first position P1, the second temperature sensor 200 may be disposed to measure the temperature of the fusing belt 120 at a second position P2 downstream of the first position P1 in the rotational direction of the fusing belt 120. At this time, the second temperature sensor 200 may be disposed to measure the temperature of the fusing belt 120 at the vicinity of the fusing nip N.

Also, the second temperature sensor 200 may measure the temperature of the fusing belt 120 at a position different from the first temperature sensor 190 in the lateral direction of the fusing belt 120. The second temperature sensor 200 may be mounted at an lateral middle portion of the fusing belt 120, such that the second temperature sensor 200 is in contact with the outside of the fusing belt 120, to measure the temperature of the fusing belt 120.

As shown in FIGS. 2 and 4, an upper frame 210 may be mounted above the support member 150, and the first temperature sensor 190 and the second temperature sensor 200 may be supported on the upper frame 210.

The upper frame 210 may include a base plate 211, a first temperature sensor fixing part 212 extending from the base plate 211 toward the fusing belt 120 at an incline, and a second temperature sensor fixing part 213 vertically extending from the base plate 211 toward the fusing belt 120.

One side of the first temperature sensor 190 may be mounted to the first temperature sensor fixing part 212 by, e.g., a screw, the other side of the first temperature sensor 190 extending toward the fusing belt 120 at an incline to come into contact with the outside of the fusing belt 120. The other side of the first temperature sensor 190 includes a sensing element 191, which may be, e.g., a thermistor. The sensing element 191 may be protected by a protective film 192.

One side of the second temperature sensor 200 is mounted to the second temperature sensor fixing part 213, e.g., by a screw. The other side of the second temperature sensor 200 vertically extends toward the fusing belt 120 to come into contact with the outside of the fusing belt 120. Similarly with the first temperature sensor 190, a sensing element 201 and a protective film 202 may be provided in the second temperature sensor 200.

At the part where the second temperature sensor 200 is in contact with the fusing belt 120, as shown in FIG. 4, the inside of the fusing belt 120 is supported by the support plates 152 of the support member 150. This configuration is provided to restrain the movement of the fusing belt 120 at the part where the second temperature sensor 200 is in contact with the fusing belt 120 (The movement of the fusing belt 120 may be greater at the middle part of the fusing belt 120 where the second temperature sensor 200 measures the temperature of the fusing belt 120 than at the remaining parts of the fusing belt 120.) so that the second temperature sensor 200 can stably measure the temperature of the fusing belt 120.

Figure 5:
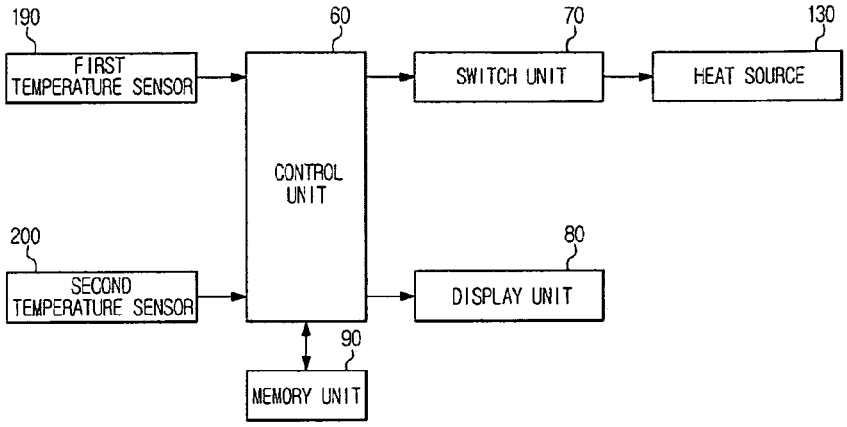
FIG. 5 is a block diagram illustrating the relevant components to control of a heat source in the image forming apparatus according to an embodiment of the present invention.

FIG. 5 is a block diagram illustrating the control of the heat source in the image forming apparatus according to an embodiment.

As shown in FIG. 5, the image forming apparatus 1 may include a control unit 60, a memory unit 90, a switch unit 70, and a display unit 80.

The control unit 60 calculates the temperature increase gradient of the fusing belt 120 from the temperature measured by the first temperature sensor 190, and controls the heat source 130 based on the result of the calculation to prevent the temperature of the fusing belt 120 from increasing excessively.

For example, the control unit 60 may measure the temperature of the first heated portion of the fusing belt 120 twice with a time delay, and calculates the increasing temperature gradient VT of the first heated portion of the fusing belt 120 from the primarily measured temperature T1 and the secondarily measured temperature T2. When it is determined that the calculated temperature increase gradient VT is equal to or greater than a predetermined reference value Vr, the control unit 60 may interrupt the supply of power to the heat source 130 through the switch unit 70.

According to an embodiment, the reference value Vr of the temperature increase gradient may be set differently depending upon the primarily measured temperature T1, measured by the first temperature sensor 190. For example, when the primarily measured temperature T1 is not greater than 150° C., V1 may be set as the reference value. When the primarily measured temperature T1 is greater than 150° C. but not greater than 175° C., V2 may be set as the reference value. When the primarily measured temperature T1 is greater than 175° C., V3 may be set as the reference value. Here, V3 is less than V2, and V2 is less than V1. For example, V1 may be 17° C./s, V2 may be 15° C./s, and V3 may be 13° C./s.

According to this embodiment, preferably, by applying different reference values depending upon the temperature T1, since the danger of overheating of the fusing belt 120 increases with the increase in temperature of the fusing belt 120, a more restrictive criterion may be used when the fusing belt 120 is at a higher temperature.

According to an embodiment, the control unit 60 may not immediately turn off the heat source 130 when an error occurs (i.e., when the calculated temperature increase gradient of the fusing belt 120 is equal to or greater than the reference value), but may turn off the heat source 130 when the error occurs repetitively, e.g., when the number of error occurrences reaches a predetermined reference value. While it may be preferable to immediately turn off the heat source 130 even when an error occurs only once from the stand point of safety, if the operation of the image forming apparatus 1 is frequently stopped, when an one time error may not represent serious condition, it is possible to create an adverse impression to the user of the image forming apparatus.

Also, the control unit 60 may control the heat source 130 in consideration of not only the increasing temperature gradient of the first heated part 121 of the fusing belt 120 calculated from temperatures measured by the first temperature sensor 190 but also the increasing temperature gradient of the second heated part 122 of the fusing belt 120 calculated from temperatures measured by the second temperature sensor 200. As a result, it is possible to more reliably prevent the overheating of the fusing belt 120 even when voltages other than the rated voltage are applied to the heat source 130 of the fusing device 100.

Hereinafter, the increasing temperature gradient of the fusing belt 120 decided from temperatures measured by the first temperature sensor 190 with time delay (the increasing temperature gradient decided at the first heated portion 121) will be referred to as a first increasing temperature gradient, and the increasing temperature gradient of the fusing belt 120 decided from temperatures measured by the second temperature sensor 200 with time delay (the increasing temperature gradient decided at the second heated portion 122) will be referred to as a second increasing temperature gradient.

Generally, the image forming apparatus 1 is designed to normally operate even when the voltage changes between the rated voltage±20% in consideration of an actual use environment in which the rated voltage may be applied to the heat source 130 of the fusing device 100.

Considering that the rated voltage is not applied to the heat source 130, however, it may be difficult to reliably deal with the overheating of the fusing belt 120 through the monitoring of only the increasing temperature gradient of the first heated portion 121 directly heated by radiant heat from the heat source 130 (the first increasing temperature gradient).

For example, when overvoltage higher than the rated voltage is applied to the heat source 130 of the fusing device 100, a relatively high first increasing temperature gradient appears in spite of the normal operation of the fusing belt 120. This increasing temperature gradient may have a value similar to that of the first increasing temperature gradient when the fusing belt 120 overheats in a situation in which low voltage is applied to the image forming apparatus 1. Consequently, when the fusing device 100 is controlled based on only the first increasing temperature gradient, power applied to the heat source 130 may be interrupted in spite of the normal operation of the fusing belt 120.

When the fusing belt 120 is normally rotated, the first increasing temperature gradient decided at the first heated portion 121 of the fusing belt 120 and the second increasing temperature gradient decided at the second heated portion 122 of the fusing belt 120 have similar values (See Table 1 below).

However, when the fusing belt 120 is stopped or rotated at an abnormally low speed, the increasing temperature gradient of the first heated portion 121 directly heated by radiant heat from the heat source 130 has a larger value than when the fusing belt 120 is normally operated at the rated voltage, whereas the increasing temperature gradient of the second heated portion 122 indirectly heated by the heat source 130 has a less value than when the fusing belt 120 is normally operated at the rated voltage. This tendency can be confirmed from experimental examples in Table 1.

Table 1 shows calculated values of the first increasing temperature gradient and the second increasing temperature gradient of the fusing belt 120 when the fusing belt 120 is normally operated and when the fusing belt 120 stops and overheats (i.e., is abnormally operated) under various voltage application conditions. In the following table, a voltage of 220V to 240V is considered as the rated voltage. The unit of the increasing temperature gradient is ° C./s.

TABLE 1

| | Normal operation of belt | | Abnormal operation of belt | |
|---|---|---|---|---|
| | First increasing temperature gradient | Second increasing temperature gradient | First increasing temperature gradient | Second increasing temperature gradient |
| 154 V | 10.30 | 3.17 | 3.98 | 4.29 |
| 165 V | 13.17 | 3.67 | 5.55 | 5.91 |
| 176 V | 14.25 | 4.83 | 5.73 | 6.10 |
| 187 V | 16.78 | 6.52 | 6.70 | 7.31 |
| 198 V | 18.53 | 6.16 | 7.46 | 8.15 |
| 220 V (Rated) | 19.79 | 6.52 | 9.10 | 9.50 |
| 240 V (Rated) | 22.13 | 7.11 | 11.12 | 11.60 |
| 264 V | 25.74 | 7.66 | 12.97 | 13.50 |
| 275 V | 26.32 | 8.43 | 14.64 | 15.20 |
| 286 V | 29.43 | 8.71 | 16.14 | 16.80 |

The control unit 60 compares the first increasing temperature gradient of the fusing belt 120 with a first reference value, and compares the second increasing temperature gradient of the fusing belt 120 with a second reference value. When the first increasing temperature gradient is greater than the first reference value, and the second increasing temperature gradient is less than the second reference value, the control unit 60 interrupts the supply of power to the heat source 130 through the switch unit 70 to prevent the overheating of the fusing belt 120. Here, the first reference value and the second reference value may be decided to be the value of the first increasing temperature gradient and the value of the second increasing temperature gradient when the fusing belt 120 is normally operated at the rated voltage. For example, when referring to Table 1 above, the first reference value may be decided to be 9.10° C./s, and the second reference value may be decided to be 9.50° C./s.

Also, when the fusing belt 120 is normally operated, the control unit 60 determines whether overvoltage or low voltage is applied to the heat source based on the result of the comparison between the first increasing temperature gradient and the first reference value and the result of the comparison between the second increasing temperature gradient and the second reference value. According to the determination, the control unit 60 appropriately controls duty ratio. Specifically, when it is determined that the overvoltage is applied to the heat source 130, the control unit 60 decreases the duty ratio. On the other hand, when it is determined that the low voltage is applied to the heat source 130, the control unit 60 increases the duty ratio. Consequently, it is possible to reduce overshoot in a situation of overvoltage application and to more quickly raise the temperature of the fusing belt 120 in a situation of low voltage application.

The memory unit 90 stores various data necessary to control the fusing device 100. Specifically, the memory unit 90 stores data related to the increasing temperature gradient of the fusing belt 120 changing depending upon the voltage applied to the heat source 130. The data include values of the first increasing temperature gradient and the second increasing temperature gradient when the fusing belt 120 is normally operated and when the fusing belt 120 stops and overheats.

The display unit 80 may display the operating status of the image forming apparatus 1. When the control unit 60 interrupts the supply of power to the heat source 130, the control unit 60 may display an error message through the display unit 80 to inform the user of an abnormal condition. Also, when it is determined that overvoltage or low voltage is applied to the heat source 130, the control unit 60 may display corresponding information through the display unit 80.

The control unit 60 may also control various other components of the image forming apparatus, e.g., one or more of the print media supply device 10, the light scanning device 20, the developing device 30, the transfer device 40, the fusing device 100, and the print media discharge device 50, to control the printing operations. To this end, according to an embodiment, the control unit 60 may be, e.g., a microprocessor, a microcontroller or the like, that includes a CPU to execute one or more computer instructions to implement the various control operations herein described, and may further include a memory device, e.g., a Random Access Memory (RAM), Read-Only-Memory (ROM), a flesh memory, or the like, to store the one or more computer instructions.

While an embodiment is described above that monitors the temperature increase gradient of the fusing belt 120 to control the heat source 130, alternatively, it may also be possible to turn off the heat source 130 when the temperature measured by the first temperature sensor 190 is equal to or greater than a predetermined reference value.

According to an embodiment, the control unit 60 caused the fusing belt 120 to be maintained at an appropriate temperature range on the basis of the temperature measured by the second temperature sensor 200. For example, assuming that a target temperature range is between TL and TH. When the temperature measured by the second temperature sensor 200 is less than TL, the control unit 60 may, through the switch unit 70, cause the heat source 130 to be operated at a higher duty ratio, and, when the temperature measured by the second temperature sensor 200 is greater than TH, the control unit 60 causes the heat source 130 to be operated at a lower duty ratio, so as to maintain the temperature of the fusing belt 120 within the target temperature range.

Figure 6:
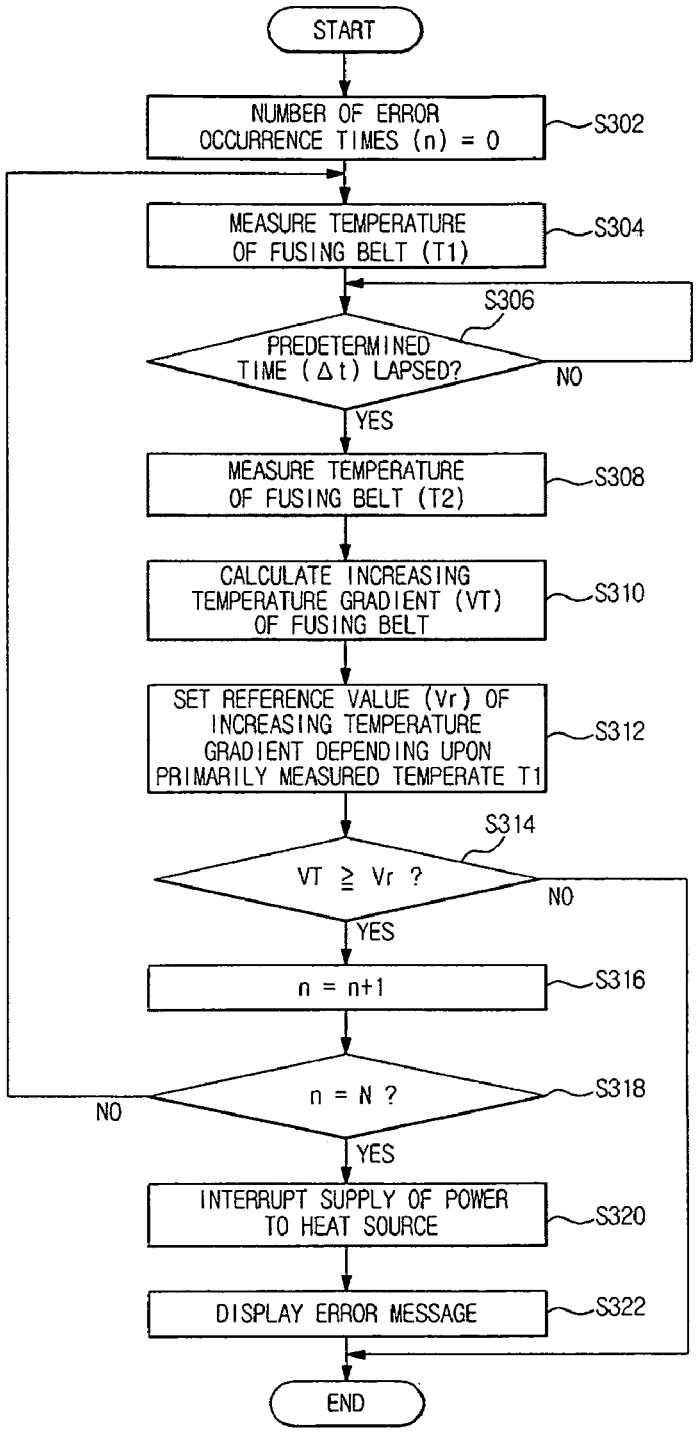
FIG. 6 is a flow chart illustrating a method of controlling the heat source using a first temperature sensor in the image forming apparatus according to an embodiment of the present invention.

Hereinafter, an embodiment of the operation of the image forming apparatus will be described with reference to FIGS. 1, 2 and 6. FIG. 6 is a flow chart illustrating an example of a method of controlling the heat source using the first temperature sensor in the image forming apparatus according to an embodiment.

When the power to the image forming apparatus 1 is turned on, the image forming apparatus is placed in a warming-up mode. In the warming-up mode, the heat source 130 of the fusing device 100 heats the fusing belt 120 to a temperature sufficient to perform a fusing operation. For example, the heat source 130 may heat the nip forming member 170, and the heated nip forming member 170 transmits heat to the fusing belt 120 through the press part 173.

The heat source 130 may also directly radiant-heat the fusing belt 120 through the second openings 155 and 175 formed at the support member 150 and the nip forming member 170, respectively, allowing rapid increase in the temperature of the fusing belt 120.

When the fusing belt is heated to the appropriate temperature, a printing operation may be commenced. Specifically, an electrostatic latent image corresponding to the image information is formed on the surface of the photoconductor 31 by the light scanning device 20, and the developing device 30 supplies toner to the photoconductor 31 such that the electrostatic latent image is developed into a toner image. A print medium S is supplied by the print media supply device 10, and the transfer device 40 transfers the toner image on the photoconductor 31 to the print medium S. The print medium, to which the toner image is transferred, passes through the press roller 140*a* and the fusing belt 120 of the fusing device 100. At this time, the toner image on the print medium is fixed to the print medium by the heat from the fusing belt 120 and the pressure acting between the press roller 140*a* and the fusing belt 120.

In the warming-up mode and/or in a printing mode, the control unit 60 monitors the temperature of the fusing belt 120 through the first temperature sensor 190 to prevent the overheating of the fusing belt 120.

As shown in FIG. 6, when an operation of monitoring the temperature of the fusing belt 120 is commenced, the control unit 60 initializes the number of error occurrences n (S302), and primarily measures the temperature of the fusing belt 120 through the first temperature sensor 190 (S304). The primarily measured temperature is T1.

Subsequently, the control unit 60 determines whether a predetermined time Δt has lapsed (S306). According to an embodiment, the predetermined time Δt may preferably be 500 ms.

After the lapse of the predetermined time Δt, the control unit 60 secondarily measures the temperature of the fusing belt 120 through the first temperature sensor 190 (S308). The secondarily measured temperature is T2.

The control unit 60 calculates the increasing temperature gradient VT of the fusing belt 120 from the measured temperatures T1 and T2 (S310). The increasing temperature gradient VT of the fusing belt 120 may be calculated according to an equation: (T2−T1)/Δt.

Subsequently, the control unit 60 sets a reference value Vr of the increasing temperature gradient of the fusing belt 120 according to the primarily measured temperature T1. For example, when T1 is not greater than 150° C., Vr may be set to be 17° C./s, when T1 is greater than 150° C. but not greater than 175° C., Vr may be set to be 15° C./s, and, when T1 is greater than 175° C., Vr may be set to be 13° C./s. It should be apparent to those skilled in the art that these actual values are given by way of examples only, and any temperature gradient value can be used as the reference value or values depending on the particular design and/or configuration of the image forming apparatus.

After the reference value of the temperature increase gradient is set, the control unit 60 determines whether the temperature increase gradient VT of the fusing belt 120, calculated at S310, is equal to or greater than the reference value Vr (S314).

When it is determined at S314 that the temperature increase gradient VT of the fusing belt 120 is equal to or greater than the reference value Vr, the control unit 60 recognizes an occurrence of an error, and counts the number of error occurrences n (S316). Subsequently, the control unit 60 determines whether the counted number of error occurrences has reached a predetermined reference value N (S318). According to one embodiment, the reference value N of the number of error occurrences may preferably be set to 3.

When it is determined at S318 that the counted number of error occurrences has reached the reference value N, the control unit 60 recognizes the possible overheating of the fusing belt 120, and interrupts the supply of power to the heat source 130 through the switch unit 70 (S320). Also, the control unit 60 displays an error message through the display unit 80 to inform a user of an abnormal condition (S322).

When, on the other hand, it is determined at S318 that the counted number of error occurrences has not reached the reference value N, the procedure may return to S304 where the subsequent operations are repeated. Also, when it is determined at S314 that the temperature increase gradient VT of the fusing belt 120 is less than the reference value Vr, the monitoring operation may be terminated, or continuously repeated from step S304.

Figure 7:
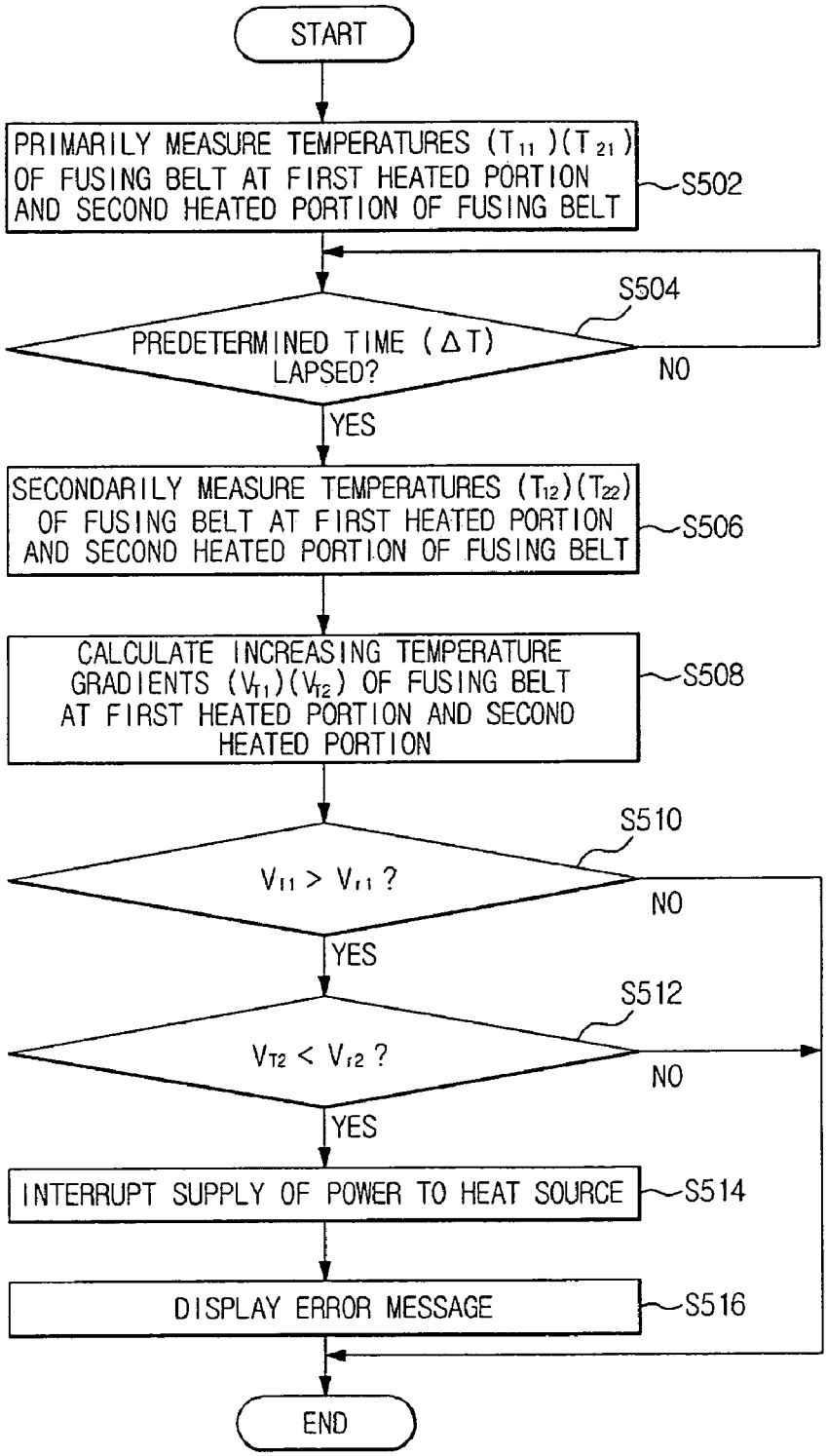
FIG. 7 is a flow chart illustrating a method of determining whether a fusing belt is normally operated using the first temperature sensor and a second temperature sensor in the image forming apparatus according to an embodiment of the present invention.

FIG. 7 is a flow chart illustrating a method of determining whether the fusing belt is normally operated using the first temperature sensor and the second temperature sensor in the image forming apparatus according to the present invention.

As shown in FIG. 7, when an operation of monitoring the temperature of the fusing belt 120 is commenced in a warming-up mode or a printing mode, the control unit 60 primarily measures the temperature of the first heated portion 121 of the fusing belt 120 through the first temperature sensor 190, and primarily measures the temperature of the second heated portion 122 of the fusing belt 120 through the second temperature sensor 200 (S502). The temperatures of the fusing belt 120 primarily measured at the first heated portion 121 and the second heated portion 122 are $T_{11}$ and $T_{21}$, respectively.

Subsequently, the control unit 60 determines whether a predetermined time Δt has lapsed (S504). Preferably, the predetermined time Δt is 500 ms.

After the lapse of the predetermined time Δt, the control unit 60 secondarily measures the temperature of the fusing belt 120 through the first temperature sensor 190 and the second temperature sensor 200 (S506). The temperatures of the fusing belt 120 secondarily measured at the first heated portion 121 and the second heated portion 122 are $T_{12}$ and $T_{22}$, respectively.

The control unit 60 calculates the increasing temperature gradient $V_{T1}$ of the fusing belt 120 at the first heated portion 121, i.e., a first increasing temperature gradient, from the measured temperatures $T_{11}$ and $T_{21}$, and calculates the increasing temperature gradient $V_{T2}$ of the fusing belt 120 at the second heated portion 122, i.e., a second increasing temperature gradient, from the measured temperatures $T_{12}$ and $T_{22}$ (S508).

Subsequently, the control unit 60 compares the first increasing temperature gradient $V_{T1}$ of the fusing belt 120 calculated at S508 with a first reference value $V_{r1}$ (S510).

When it is determined at S510 that the first increasing temperature gradient $V_{T1}$ of the fusing belt 120 is greater than the first reference value $V_{r1}$, the control unit 60 compares the second increasing temperature gradient $V_{T2}$ of the fusing belt 120 calculated at S508 with a second reference value $V_{r2}$ (S512). Here, the first reference value $V_{r1}$ and the second reference value $V_{r2}$ may be decided to be the value of the first increasing temperature gradient and the value of the second increasing temperature gradient when the fusing belt 120 is normally operated at the rated voltage. For example, when referring to Table 1, the first reference value may be decided to be 9.10° C./s, and the second reference value may be decided to be 9.50° C./s.

When it is determined at S512 that the second increasing temperature gradient $V_{T2}$ of the fusing belt 120 is less than the second reference value $V_{r2}$, the control unit 60 interrupts the supply of power to the heat source through the switch unit 70 (S514). Also, the control unit 60 displays an error message through the display unit 80 to inform a user of an abnormal situation (S516).

On the other hand, when it is determined at S510 or S512 that the first increasing temperature gradient $V_{T1}$ of the fusing belt 120 is not greater than the first reference value $V_{r1}$, or the second increasing temperature gradient $V_{T2}$ of the fusing belt 120 is not less than the second reference value $V_{r2}$, the monitoring operation is terminated.

Figure 8:
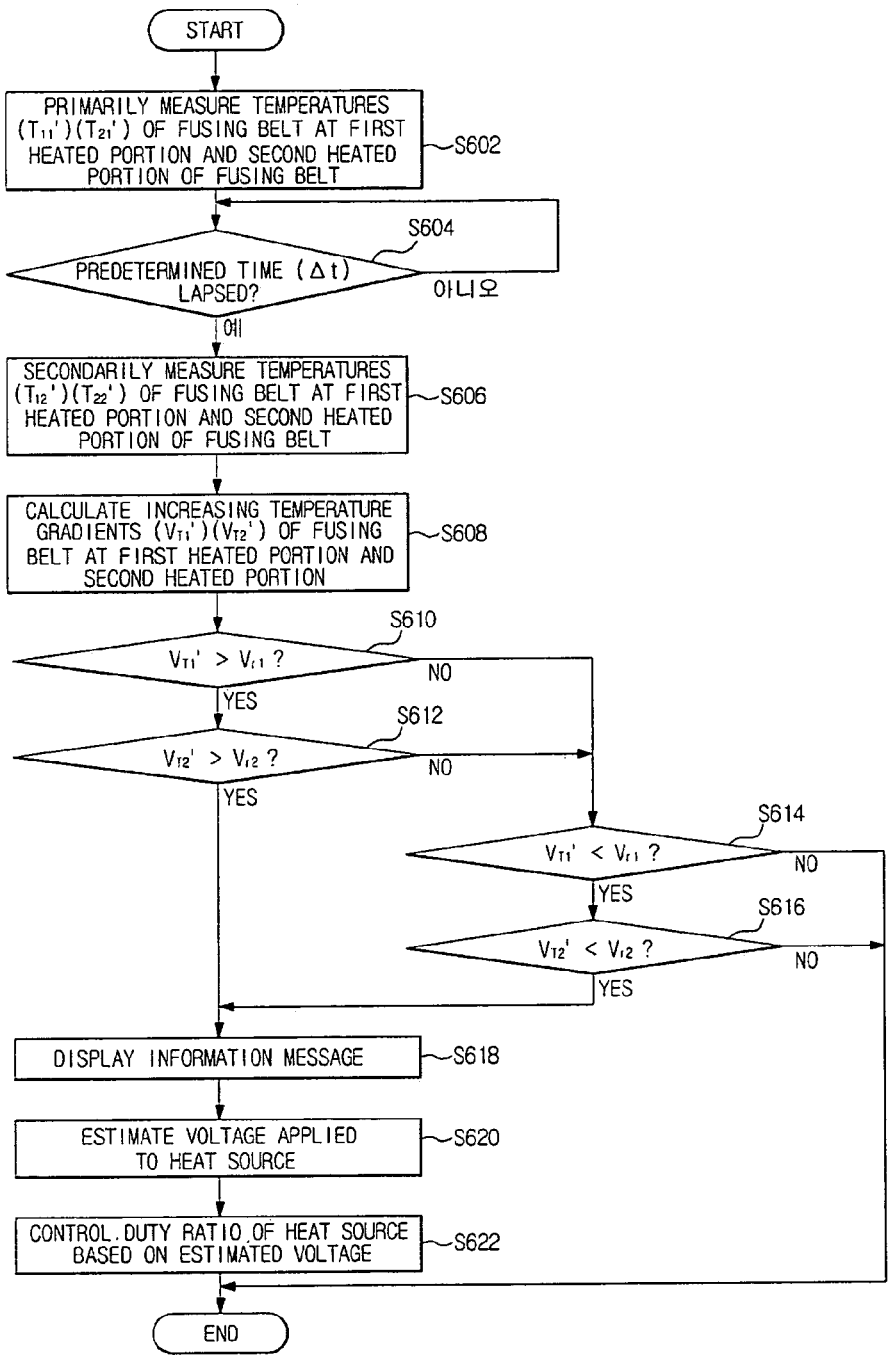
FIG. 8 is a flow chart illustrating a method of controlling the heat source using the first temperature sensor and the second temperature sensor, when the fusing belt is normally operated, in the image forming apparatus according to an embodiment of the present invention.

FIG. 8 is a flow chart illustrating a method of controlling the heat source using the first temperature sensor and the second temperature sensor, when the fusing belt is normally operated, in the image forming apparatus according to the present invention.

As shown in FIG. 8, when an operation of monitoring the temperature of the fusing belt 120 is commenced during the normal operation of the fusing belt 120, the control unit 60 primarily measures the temperature of the first heated portion 121 of the fusing belt 120 through the first temperature sensor 190, and primarily measures the temperature of the second heated portion 122 of the fusing belt 120 through the second temperature sensor 200 (S602). The temperatures of the fusing belt 120 primarily measured at the first heated portion 121 and the second heated portion 122 are $T_{11}'$ and $T_{21}'$, respectively.

Subsequently, the control unit 60 determines whether a predetermined time Δt has lapsed (S604). After the lapse of the predetermined time Δt, the control unit 60 secondarily measures the temperature of the fusing belt 120 through the first temperature sensor 190 and the second temperature sensor 200 (S606). The temperatures of the fusing belt 120 secondarily measured at the first heated portion 121 and the second heated portion 122 are $T_{12}'$ and $T_{22}'$, respectively.

The control unit 60 calculates a first increasing temperature gradient $V_{T1}'$ of the fusing belt 120 at the first heated portion 121 from the measured temperatures $T_{11}'$ and $T_{21}'$, and calculates a second increasing temperature gradient $V_{T2}'$ of the fusing belt 120 at the second heated portion 122 from the measured temperatures $T_{12}'$ and $T_{22}'$ (S608).

Subsequently, the control unit 60 compares the first increasing temperature gradient $V_{T1}'$ of the fusing belt 120 calculated at S608 with a first reference value $V_{r1}$, and compares the second increasing temperature gradient $V_{T2}'$ of the fusing belt 120 calculated at S608 with a second reference value $V_{r2}$ (S610 to S616). Here, the first reference value $V_{r1}$ and the second reference value $V_{r2}$ may be decided to be the value of the first increasing temperature gradient and the value of the second increasing temperature gradient when the fusing belt 120 is normally operated at the rated voltage.

The control unit 60 determines whether the first increasing temperature gradient $V_{T1}'$ of the fusing belt 120 calculated at S608 is greater than the first reference value $V_{r1}$ and whether the second increasing temperature gradient $V_{T2}'$ of the fusing belt 120 calculated at S608 is greater than the second reference value $V_{r2}$ (S610 and S612).

When it is determined at S610 and S612 that the first increasing temperature gradient $V_{T1}'$ is greater than the first reference value $V_{r1}$ and the second increasing temperature gradient $V_{T2}'$ is greater than the second reference value $V_{r2}$, the control unit 60 recognizes that overvoltage higher than the rated voltage is applied to the heat source 130 and displays a related message through the display unit 80 (S618). Also, the control unit 60 compares the calculated first increasing temperature gradient $V_{T1}'$ and the calculated second increasing temperature gradient $V_{T2}'$ with data stored in the memory unit 90, i.e., data related to the increasing temperature gradient of the fusing belt 120 changing depending upon various applicable voltage, to estimate how higher voltage than the rated voltage is applied to the heat source 130 (S620).

Subsequently, the control unit 60 appropriately decreases duty ratio of the heat source 130 based on the estimated voltage to prevent the occurrence of problems caused by overvoltage applied to the heat source 130 (S622).

On the other hand, when it is determined at S610 and S612 that the first increasing temperature gradient $V_{T1}'$ is not greater than the first reference value $V_{r1}$ and the second increasing temperature gradient $V_{T2}'$ is not greater than the second reference value $V_{r2}$, the control unit 60 determines whether the first increasing temperature gradient $V_{T1}'$ is less than the first reference value $V_{r1}$ and the second increasing temperature gradient $V_{T2}'$ is less than the second reference value $V_{r2}$ (S614 and S616).

When it is determined at S614 and S616 that the first increasing temperature gradient $V_{T1}'$ is less than the first reference value $V_{r1}$ and the second increasing temperature gradient $V_{T2}'$ is less than the second reference value $V_{r2}$, the control unit 60 recognizes that voltage lower than the rated voltage is applied to the heat source 130 and displays a related message through the display unit 80 (S618). Also, the control unit 60 compares the calculated first increasing temperature gradient $V_{T1}'$ and the calculated second increasing temperature gradient $V_{T2}'$ with data stored in the memory unit 90 to estimate how lower voltage than the rated voltage is applied to the heat source 130 (S620).

Subsequently, the control unit 60 appropriately increases duty ratio of the heat source 130 based on the estimated voltage to prevent the occurrence of problems caused by low voltage applied to the heat source 130 (S622).

Figure 9:
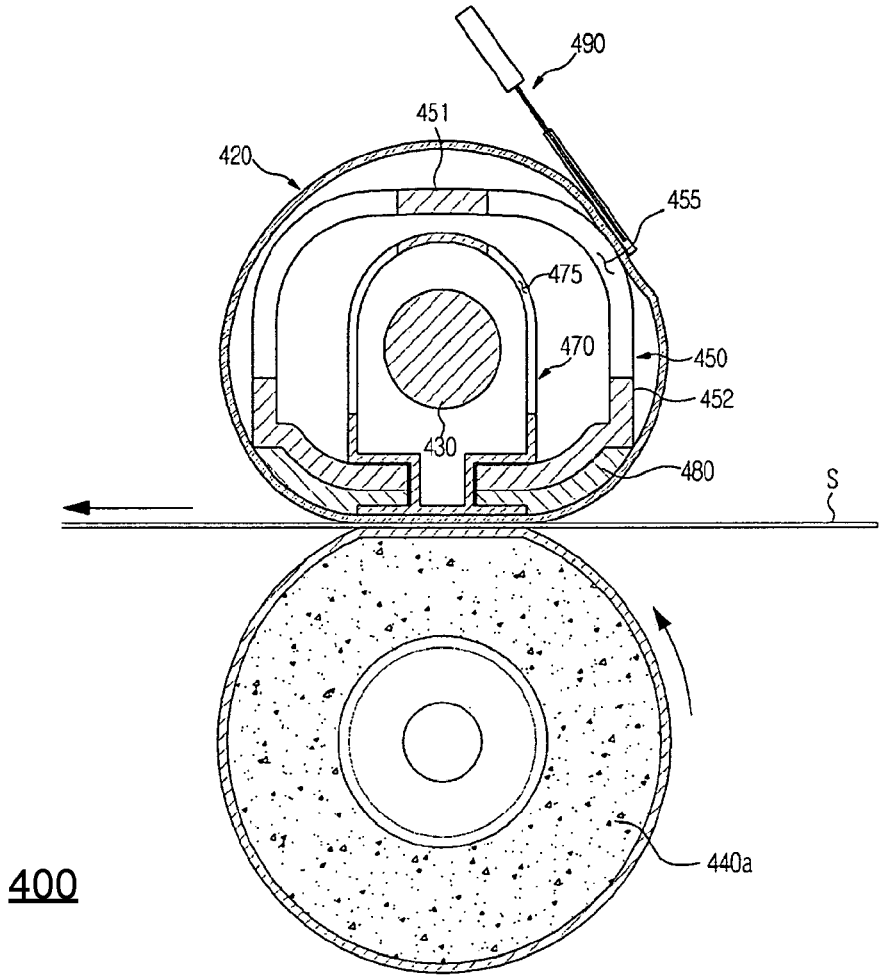
FIG. 9 is a sectional view illustrating the structure of a fusing device according to another embodiment of the present invention.
Figure 10:
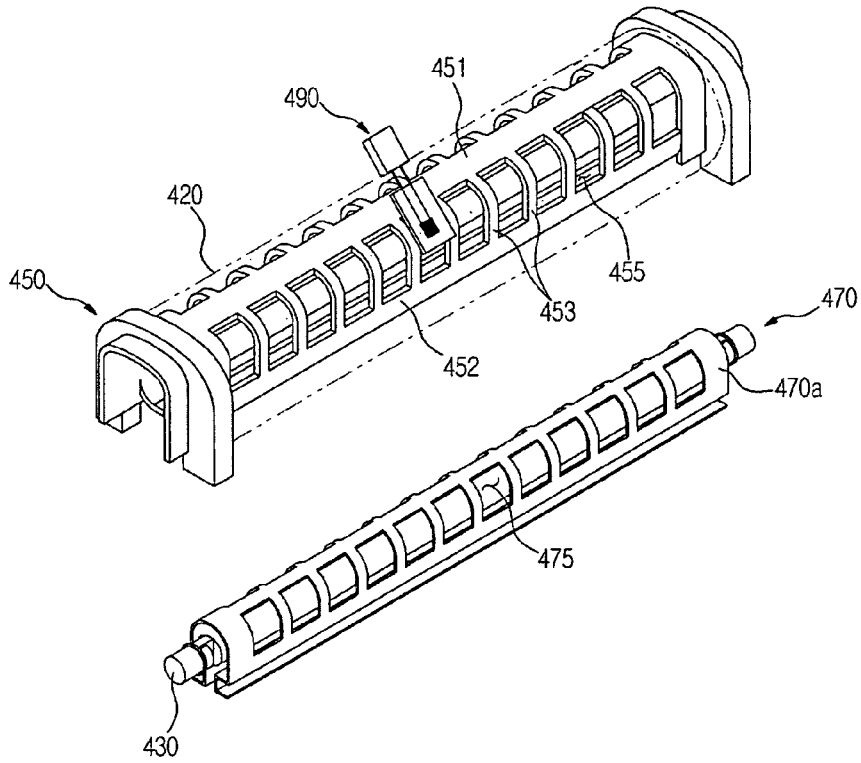
FIG. 10 is a perspective view illustrating some components of the fusing device of FIG. 9.

FIG. 9 is a sectional view illustrating the structure of a fusing device according to another embodiment of the present invention, and FIG. 10 is a perspective view illustrating relevant components of the fusing device of FIG. 9. One of the aspects of this embodiment different from the previously described embodiments is the installation structure of a temperature sensor provided to prevent the overheating of a fusing belt is modified.

As shown in FIGS. 9 and 10, a fusing device 400 may include a fusing belt 420, a heat source 430, a support member 450, a nip forming member 470, a belt guide member 480, and a press roller 440*a*. Hereinafter, the characteristics of this embodiment that are distinguished from the previously described embodiments will be described.

The support member 450 may have a reinforcing rib 451 disposed inside the fusing belt 420 such that the reinforcing rib 451 crosses the top of the support member 450 in the lateral direction. Between the reinforcing rib 451 and a support plate 452 are disposed a plurality of connection ribs 453 to interconnect the reinforcing rib 451 and the support plate 452.

Between the respective connection ribs 453 are defined openings 455 through which radiant heat from the heat source 430 directly flows out of the support member 450.

A temperature sensor 490 is mounted outside the fusing belt 420 at a position corresponding to one of the openings 455. The temperature sensor 490 is in contact with the outer surface of the fusing belt 420 to measure the temperature of the fusing belt 420. The control unit (not shown, but previously described) of the image forming apparatus controls the heat source 430, based on the temperature of the fusing belt 420 as measured by the temperature sensor 490, to prevent the overheating of the fusing belt 420.

The temperature sensor 490 may be mounted at a lateral middle portion of the fusing belt 420. The inside of the fusing belt 420 is supported by the connection ribs 453 while the temperature sensor 490 is in contact with the outside of the fusing belt 420. Consequently, the temperature sensor 490 is in stable contact with the fusing belt 420.

The body part 470*a* of the nip forming member 470 has openings 475 corresponding to the openings 455 of the support member 450. The heat source 430 directly radiant-heats the fusing belt 420 through the openings 455 of the support member 450 and the openings 475 of the nip forming member 470.

Figure 11:
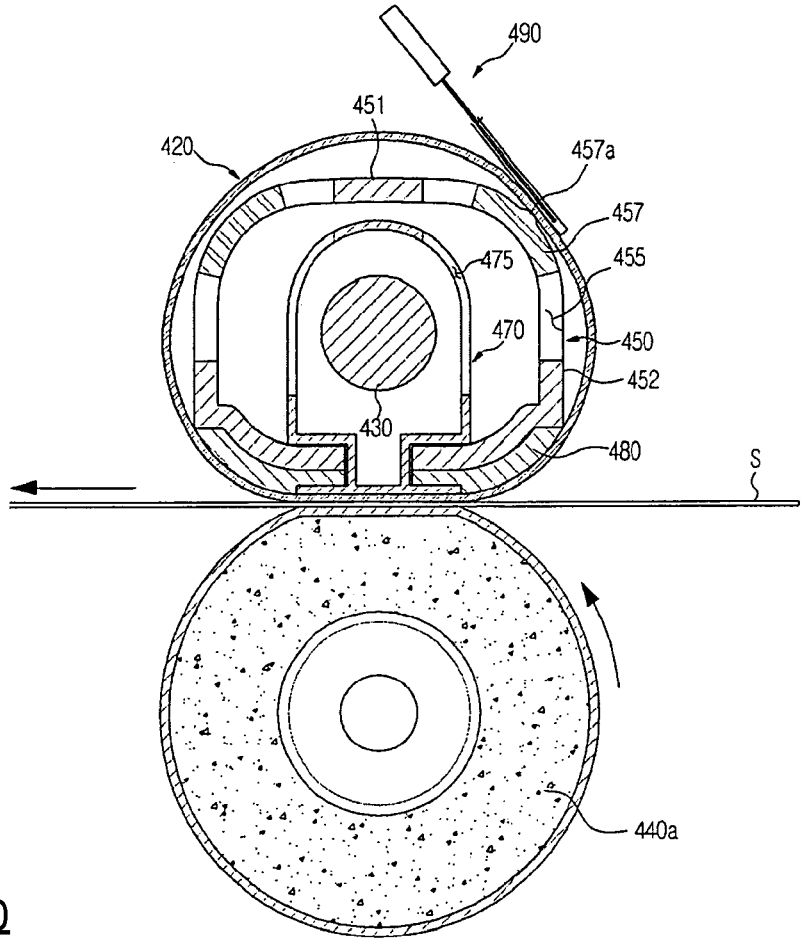
FIG. 11 is a view illustrating an example in which a light transmission member is mounted at openings of a support member in the fusing device of FIG. 9.

FIG. 11 is a view illustrating an example in which a light transmission member 457 is mounted at the openings of the support member in the fusing device of FIG. 9.

As shown in FIG. 11, the light transmission member 457 may be mounted at the openings 455 of the support member 450 such that the light transmission member 457 corresponds to the installation position of the temperature sensor 490. The light transmission member 457 allows the heat emitted from the heat source 430 to be directly transmitted to the fusing belt 420. Also, the light transmission member 457 supports the inside of the fusing belt 420 at the installation position of the temperature sensor 490. As the light transmission member 457 is mounted at the openings 455 of the support member 450, a more secure contact between the temperature sensor 490 and the outside of the fusing belt 420 is achieved.

A protrusion 457*a* is preferably formed at the light transmission member 457 in contact with the fusing belt 420. The protrusion 457*a* reduces the contact area between the light transmission member 457 and the fusing belt 420, thereby minimizing the heat loss of the fusing belt 420 and preventing the possibility of damage to the fusing belt 420 due to the friction between the light transmission member 457 and the fusing belt 420.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising: a fusing device including a heat source configured to produce heat, a fusing belt and a first temperature sensor, the fusing belt having a direct heated portion thereof that receives direct radiant-heat from the heat source, a support member supporting at least a portion of inner circumferential surface of the fusing belt, the support member having an opening through which heat produced by the heat source radiates to the direct heated portion of the fusing belt, the first temperature sensor being arranged to sense a temperature of the fusing belt at the direct heated portion of the fusing belt; and a control unit configured to calculate a temperature increase gradient VT of the fusing belt from a first temperature T1 sensed by the first temperature sensor and a second temperature T2 sensed by the first temperature sensor, the second temperature being sensed after a time delay A t from sensing of the first temperature and the temperature increase gradient being obtained according to an equation, VT=(T2−T1)/At, and to interrupt supply of power to the heat source based on a comparison of the calculated temperature increase gradient VT and a reference value Vr.

2. The image forming apparatus according to claim 1, wherein the first temperature sensor being in contact with an outer circumferential surface of the fusing belt at the direct heated portion.

3. The image forming apparatus according to claim 2, wherein the direct heated portion includes a print media contact portion which comes into contact with a print medium passing through the fusing device and an edge portion located outside the print media contact portion, the first temperature sensor contacting the fusing belt at the edge portion.

4. The image forming apparatus according to claim 1, wherein the control unit is further configured to select one of a plurality of values as the reference value Vr based on the first temperature.

5. The image forming apparatus according to claim 1, wherein the control unit is further configured to interrupt supply of power to the heat source upon detecting a number of occurrences of an error condition, in which the temperature increase gradient VT of the fusing belt is equal to or greater than the reference value Vr, reaching a predetermined reference number.

6. A fusing device, comprising:

a heat source configured to produce heat;

a fusing belt disposed around the heat source;

a press member arranged to be in pressing contact with an outer circumferential surface of the fusing belt;

a nip forming member disposed to support an inner circumferential surface of the fusing belt, and to oppose the press member to thereby form a fusing nip between an outer circumferential surface of the fusing belt and the press member, the nip forming member including a press part contacting the inner circumferential surface of the fusing belt and a first opening through which the heat emitted from the heat source is allowed to radiate to the press part;

a support member rotatably supporting the fusing belt, the support member defining a second opening through which heat from the heat source is allowed to directly radiate to a direct heated portion of the fusing belt;

a temperature sensor disposed to be in contact with the outer circumferential surface to sense a temperature of the fusing belt at the direct heated portion of the fusing belt; and a control unit to calculate a temperature increase gradient of the fusing belt as a difference between a first temperature measured by the temperature sensor and the second temperature by the temperature sensor after a time delay, divided by the time delay, and to control an operation of the heat source according to a comparison of the calculated temperature increase gradient and a reference value.

7. An image forming apparatus, comprising:

a fusing device including a heat source to generate heat, a fusing belt having a first heated portion directly heated by radiant heat from the heat source and a second heated portion indirectly heated by heat from the heat source, a first temperature sensor to measure a temperature of the fusing belt at the first heated portion of the fusing belt, and a second temperature sensor to measure a temperature of the fusing belt at the second heated portion of the fusing belt; and a control unit to control an operation of the heat source according to a first temperature increase gradient of the fusing belt and a second temperature increase gradient of the fusing belt, wherein the control unit determines the first temperature increase gradient of the fusing belt from temperatures measured by the first temperature sensor with a first time delay and determines the second temperature increase gradient of the fusing belt from temperatures measured by the second temperature sensor with a second time delay.

8. The image forming apparatus according to claim 7, further comprising at least one member disposed between the heat source and the fusing belt on a route along which heat from the heat source is transmitted to the fusing belt.

9. The image forming apparatus according to claim 8, wherein the at least one member includes an opening to allow heat radiated from the heat source to directly heat the first heated portion of the fusing belt through the at least one member.

10. The image forming apparatus according to claim 8, wherein the at least one member prevents heat radiated from the heat source from directly heating the second heated portion of the fusing belt.

11. The image forming apparatus according to claim 7, wherein at least one member including a support member disposed at least partially between the heat source and the fusing belt, and the support member has an opening to allow heat radiated from the heat source to directly heat the first heated portion of the fusing belt through the support member.

12. The image forming apparatus according to claim 7, wherein the control unit compares the first temperature increase gradient and the second temperature increase gradient with a first reference value and a second reference value, respectively.

13. A method of controlling a fusing device of an image forming apparatus, the fusing device including a fusing belt disposed around a heat source and a support member supporting at least a portion of inner circumferential surface of the fusing belt, the support member having an opening through which heat produced by the heat source radiates to a direct heated portion of the fusing belt, the method comprising:

sensing a first temperature of the direct heated portion of the fusing belt, the direct heated portion of the fusing belt directly receiving radiated heat from the heat source;

sensing a second temperature of the direct heated portion of the fusing belt at a time delay after sensing of the first temperature;

determining a temperature increase gradient by dividing a difference between the first temperature and the second temperature by the time delay;

comparing the temperature increase gradient with a reference gradient value; and controlling an operation of the heat source based on a result of the comparison of the temperature increase gradient with the reference gradient value.

14. The method as set forth in claim 13, further comprising:

determining a number of occurrences of an error condition, the error condition being a condition in which the temperature increase gradient is equal to or greater than the reference gradient value;

determining whether the number of occurrences of the error condition equals a reference number; and interrupting supply of power to the heat source if the number of occurrences of the error condition equals the reference number.

15. A method of controlling a fusing device of an image forming apparatus, the fusing device including a fusing belt disposed around a heat source, the method comprising:

primarily measuring temperature of a first heated portion directly heated by radiant heat from the heat source at the fusing belt and temperature of a second heated portion indirectly heated by heat from the heat source at the fusing belt;

secondarily measuring temperatures of the first heated portion and the second heated portion;

deciding an increasing temperature gradient of the first heated portion from the primarily measured temperature and the secondarily measured temperature at the first heated portion;

deciding an increasing temperature gradient of the second heated portion from the primarily measured temperature and the secondarily measured temperature at the second heated portion; and comparing the increasing temperature gradient of the first heated portion with a first reference value and the increasing temperature gradient of the second heated portion with a second reference value.

16. The method according to claim 15, further comprising interrupting the supply of power to the heat source when the increasing temperature gradient of the first heated portion is greater than the first reference value and the increasing temperature gradient of the second heated portion is less than the second reference value.

17. The method according to claim 15, further comprising determining that overvoltage is applied to the heat source when the increasing temperature gradient of the first heated portion is greater than the first reference value and the increasing temperature gradient of the second heated portion is greater than the second reference value.

18. The method according to claim 15, further comprising determining that low voltage is applied to the heat source when the increasing temperature gradient of the first heated portion is less than the first reference value and the increasing temperature gradient of the second heated portion is less than the second reference value.

* * * * *